US005819656A

United States Patent [19]

Gertsch et al.

[11] Patent Number: 5,819,656

[45] Date of Patent: Oct. 13, 1998

[54] APPARATUS FOR ADJUSTING AN INKING OR DAMPENING-DEVICE ROLLER OF A PRINTING MACHINE

[75] Inventors: Peter Gertsch, Niederscherli; Robert Imhof, Bern, both of Switzerland

[73] Assignee: Gimaco Ingenieur Ag Für Maschinenbau, Koeniz, Switzerland

[21] Appl. No.: 922,238

[22] Filed: Sep. 3, 1997

[30] Foreign Application Priority Data

Sep. 3, 1996 [EP] European Pat. Off. ..... 968110580

[51] Int. Cl.[6] ..... B41F 31/00

[52] U.S. Cl. ..... 101/352.09; 101/352.09; 101/247

[58] Field of Search ..... 101/352.09, 352.01, 101/352.02, 352.03, 352.04, 352.07, 352.08, 247

[56] References Cited

U.S. PATENT DOCUMENTS

| | | | |
|---|---|---|---|
| 2,177,261 | 10/1939 | Lembeke | 101/352.08 |
| 3,635,160 | 1/1972 | Specht | 101/352.01 |
| 3,678,849 | 7/1972 | Musgrave | 101/352.09 |
| 3,683,805 | 8/1972 | Harless | 101/352.09 |
| 5,179,898 | 1/1993 | Sun | 101/352.09 |
| 5,590,598 | 1/1997 | Keller | 101/352.09 |

*Primary Examiner*—Eugene H. Eickholt

*Attorney, Agent, or Firm*—Oblon, Spivak, McClelland, Maier & Neustadt, P.C.

[57] ABSTRACT

The ends of an inking- or dampening-device roller are mounted in respective bearing arrangements displaceable along a control surface co-operating with a guide part. The control surface includes an adjustment zone and a further zone. The adjustment zone runs substantially parallel to an angle bisector of an angle formed by two lines connecting the axis of the inking- or dampening-device roller to the respective axes of the adjacent stationary rollers. Only a single linear drive is necessary for displacing the bearing arrangement.

15 Claims, 5 Drawing Sheets

APPARATUS FOR ADJUSTING AN INKING OR DAMPENING-DEVICE ROLLER OF A PRINTING MACHINE

BACKGROUND OF THE INVENTION

1. Field of the Invention

This invention relates generally to printing machines, and more particularly to an apparatus for adjusting an inking- or dampening-device roller of a printing machine relative to two further adjacent rollers rotatingly mounted in a machine frame of the printing machine, of the type in which each of the two ends of the spindle of the inking- or dampening-device roller is mounted in a bearing arrangement which is displaceable via drive means relative to the machine frame in a plane perpendicular to the spindle.

2. Discussion of the Background

In printing machines, especially in high-speed web-fed rotary presses, it has proven advantageous for the inking- or dampening-device rollers to be adjustably mounted, i.e., for the contact pressure against the adjacent rollers with which the adjustable rollers come in contact to be adaptable even during production. Such adjustable inking- or dampening-device rollers have a soft, resilient surface. In the case of permanently set rollers, the contact pressure against the adjacent rollers with which they are in contact can thereby vary. The reason for this is that the conditions vary from standstill of the machine, when the contact pressure can be set in a manner known per se by affixing a replica, e.g., of the inking roller, to the plate cylinder, up to full production speed. The higher the speed, the greater the pressure.

The temperature may also have an influence upon the contact pressure of these rollers. When production is commenced, it may go from room temperature up to a certain operating temperature, which likewise results in an increase of the contact pressure.

All these variations of the contact pressure between the respective rollers may have an adverse effect upon the printing quality.

As shown by investigations into the rolling action of multi-roller systems with the inclusion of viscoelastic rollers, an adaptation of the contact pressure to the running speed is particularly desirable because, otherwise, the necessary torque for driving the rollers increases enormously. Thus, optimum adjustment of the rollers can save energy as well.

Apparatus for adjusting inking- or dampening-device rollers has already been proposed. For example, U.S. Pat. No. 5,142,977 shows such an apparatus. Here, each bearing arrangement of an adjustable roller in which a journal is mounted contains two adjusting apparatuses disposed substantially at right angles to each other, by means of which the bearing arrangements can be adjusted relative to the machine frame in any direction of a plane within the adjustment range.

This apparatus provides all possibilities of putting the respective adjustable roller into the desired position. It has turned out, however, that this apparatus is very costly to manufacture and is consequently also expensive, and that the space requirement is considerable, so that it cannot be used in all machines.

SUMMARY OF THE INVENTION

It is therefore an object of this invention to provide an improved apparatus for adjusting an inking- or dampening-device roller which enables the adjustment of the respective rollers in the desired manner while being of simple construction.

A further object of the invention is to provide a roller-adjusting apparatus which is less expensive to manufacture than prior art apparatus.

Still another object of the invention is to provide such apparatus which can be fitted in a printing machine even where little space is available.

To this end, in the adjusting apparatus according to the present invention, of the type initially mentioned, the improvement consists in providing each of the two bearing arrangements with a guide part co-operating with a control surface, and the control surface having at least one adjustment zone running substantially parallel to an angle bisector of an angle formed by two connection lines contained in the plane perpendicular to the roller spindle, each of which lines connects the axis of the inking- or dampening-device roller to one of the two mentioned adjacent rollers, and the drive means for displacing each of the two bearing arrangements consisting of a single linear drive.

By using just one linear drive and a control surface, the inventive apparatus can be constructed simply and compactly. Preferably, only one control surface per bearing arrangement is provided, the guide part and the control surface being pressed against each other by means of a resilient element, thus ensuring guidance of the bearing arrangement free of play.

The inventive apparatus may be designed in such a way that in addition to the adjustment of the respective roller, it also enables one of the adjacent rollers to be disengaged while still remaining in contact with the other adjacent roller. This design makes it simple to disengage an inking roller from the plate cylinder without the necessity of additional drives, whereby the inventive apparatus is still of simple construction. In particular, a disengaged roller can easily be re-engaged with the other two rollers repeatedly.

Another advantageous design of the invention consists in having each bearing arrangement fixed to a support part held in a mount. The support part is connected to the mount by a swiveling lever held pivotingly in the mount and pivoted on the support part. The support part can thereby easily follow the cam when the support part is displaced along one of the spindles in relation to the mount for adjusting the roller. Preferably only one swiveling lever is used, in which case the support part must be provided laterally with underpinning means. Thus only the first spindle, which is rotatingly but non-slidingly held in the support part, is provided in its middle region with a thread screwed into a matching counterthread in the swiveling lever so that by rotating this spindle by means of a motor and a gear, this spindle can be displaced together with the support part.

Through the use of a swiveling lever, the cam may have virtually any desired shape, so that when it is affixed to a component fastened detachably and replaceably to the support part, it can be adapted in shape to the desired requirements. The guide part is preferably adjustable relative to the mount to which it is secured, so that when the roller is set in the bearing arrangements, the ratio of the contact pressure against the two adjacent rollers is variable and adaptable to the particular needs.

The roller is preferably adjusted automatically via a control device as a function of selectable parameters. The roller thereby occupies an optimum position during operation of the printing machine.

A position indicator is preferably provided for determining the momentary position of the roller, which position may be reported back to the control unit.

By activating the motor, the control unit may also bring about an adjustment as a function of a contact pressure of the roller against the adjacent rollers as measured by a pressure gauge.

BRIEF DESCRIPTION OF THE DRAWINGS

Preferred embodiments of the invention will now be described in detail with reference to the accompanying drawings, in which.

DISCUSSION OF THE PREFERRED EMBODIMENTS

Figure 1:
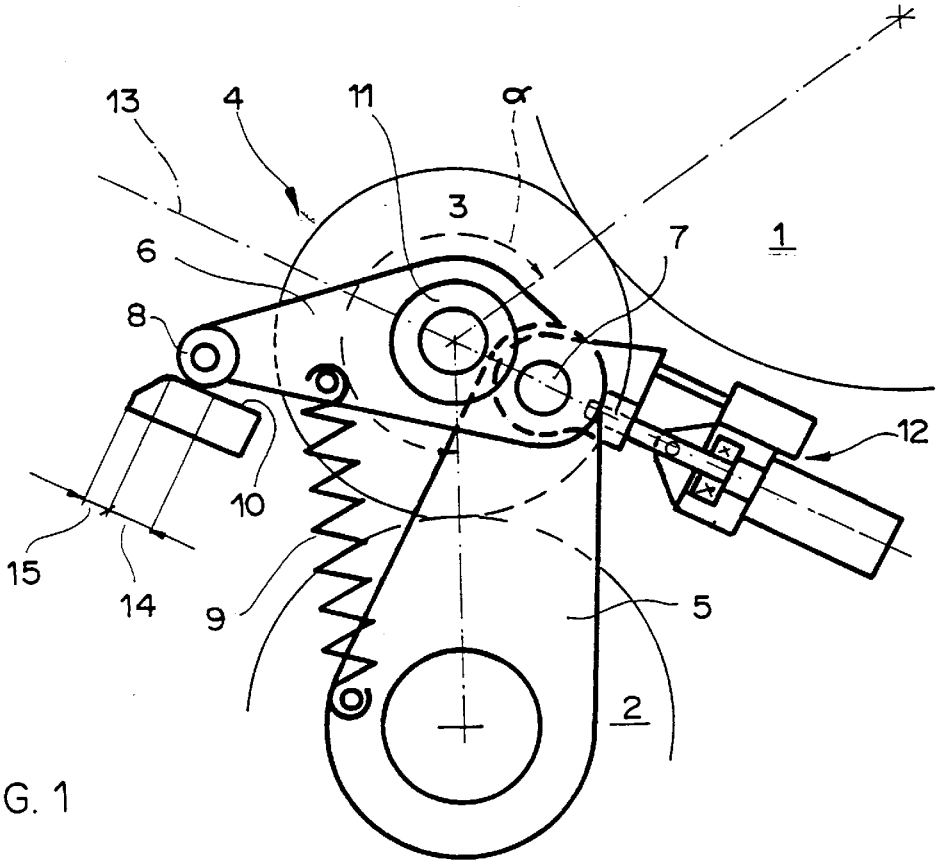
FIG. 1 is a diagram of a first design principle of the inventive apparatus.

FIG. 1 shows diagrammatically a plate cylinder 1 of a printing machine (not shown) and a distributor roller 2. Disposed between plate cylinder 1 and distributor roller 2 is an inking roller 3 held at both ends in an appa- ratus 4 according to the present invention. Apparatus 4 consists essentially of a swiveling lever 5 pivoted about the axis of distributor roller 2. Pivoted on swiveling lever 5 about a spindle 7 is a guide lever 6. Secured to the end of guide lever 6 remote from spindle 7 is a guide part 8. Lever 6, and thus guide part 8, are pressed by means of a spring 9 against a control surface 10 held stationary in a manner known per se in relation to the machine frame of the printing machine.

Inking roller 3 is pivoted in guide lever 6 about a spindle 11. Via a linear drive 12, operatively connected to swiveling lever 5, apparatus 4 can be pivoted about the axis of distributor roller 2. When swiveling lever 5 is swiveled by linear drive 12, guide part 8 runs along control surface 10, whereby inking roller 3 mounted in guide lever 6 is moved substantially along a straight line 13 running parallel to control surface 10. By displacement of inking roller 3, it can thus be pressed to a greater or lesser extent against plate cylinder 1 and distributor roller 2.

It is quite conceivable for control surface 10 to be inclined to a certain degree relative to the angle bisector of angle a, whereby, upon displacement of inking roller 3, the contact pressures against plate cylinder 1 and distributor roller 2 are no longer varied in accordance with one another but rather in a certain proportion determined by the inclination of control surface 10.

The adjustment of inking roller 3 in relation to plate cylinder 1 and distributor roller 2 takes place along an adjustment zone 14 of control surface 10. Adjoining adjustment zone 14, control surface 10 has a further zone 15 inclined toward distributor roller 2. When inking roller 3 is adjusted away from plate cylinder 1 and distributor roller 2, guide part 8 moves from adjustment zone 14 of control surface 10 into the further zone 15, and guide lever 6 is pulled by spring 9 toward distributor roller 2, so that inking roller 3 is disengaged from plate cylinder 1 and is still in contact only with distributor roller 2. The contact pressure of inking roller 3 against distributor roller 2 is determined by the force of spring 9. When inking roller 3 is disengaged from plate cylinder 1, the inking rollers of the printing machine can be pre-inked, for example, in a manner known per se.

Figure 2:
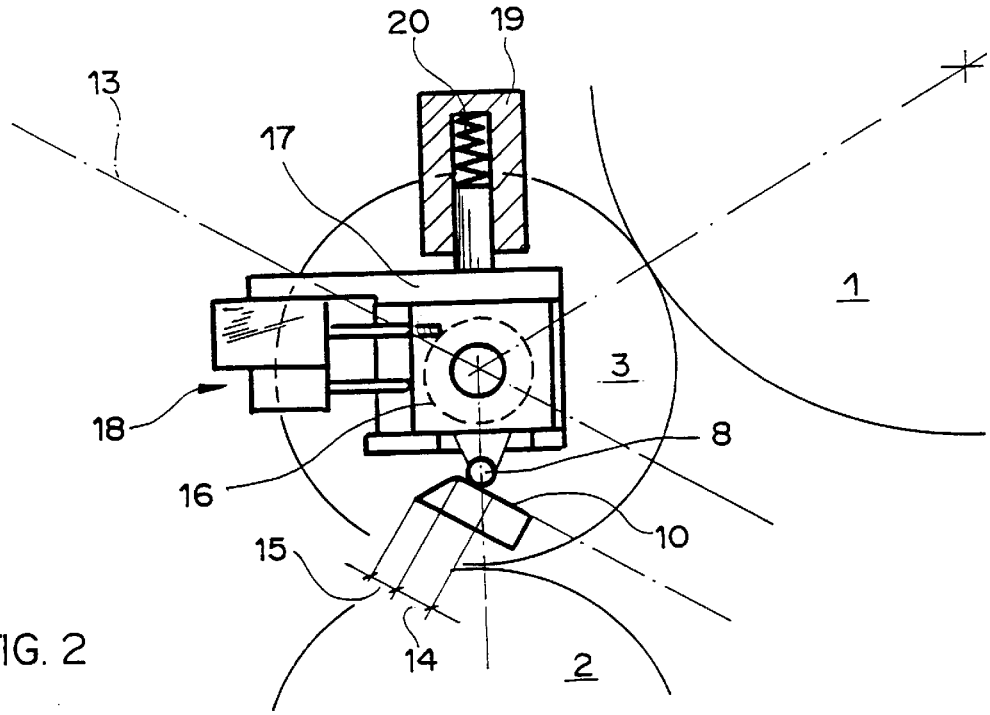
FIG. 2 is a diagram of a second design principle of the inventive apparatus.

The principle diagrammatically illustrated in FIG. 2 functions similarly. Inking roller 3 to be adjusted relative to plate cylinder 1 and distributor roller 2 is mounted in a shifting part 16 held displaceably, via a linear drive 18, in a receiving part 17, which is in turn guided displaceably by a guide 19. Shifting part 16 includes a guide part 8 co-operating with a control surface 10, toward which it is biased by a spring 20. As in the principle of FIG. 1, control surface 10 is aligned substantially parallel to angle bisector 13. When shifting part 16 is displaced via linear drive 18, distributor roller 2 follows angle bisector 13, in accordance with the development described in connection with FIG. 1. Here, too, control surface 10 has an adjustment zone 14 and a further zone 15, so that the same adjustment possibilities exist and the disengagement of inking roller 3 may be carried out as in the embodiment of FIG. 1.

It is also conceivable to provide another control surface parallel to control surface 10, whereby guide part 8 would be forcibly guided through these two control surfaces. The spring element could then be dispensed with, and the disengagement of inking roller 3, particularly the adjustment of the contact pressure against distributor roller 2, could then be effected via linear drive 12 or 18, respectively, by running into the proper position.

Figure 3:
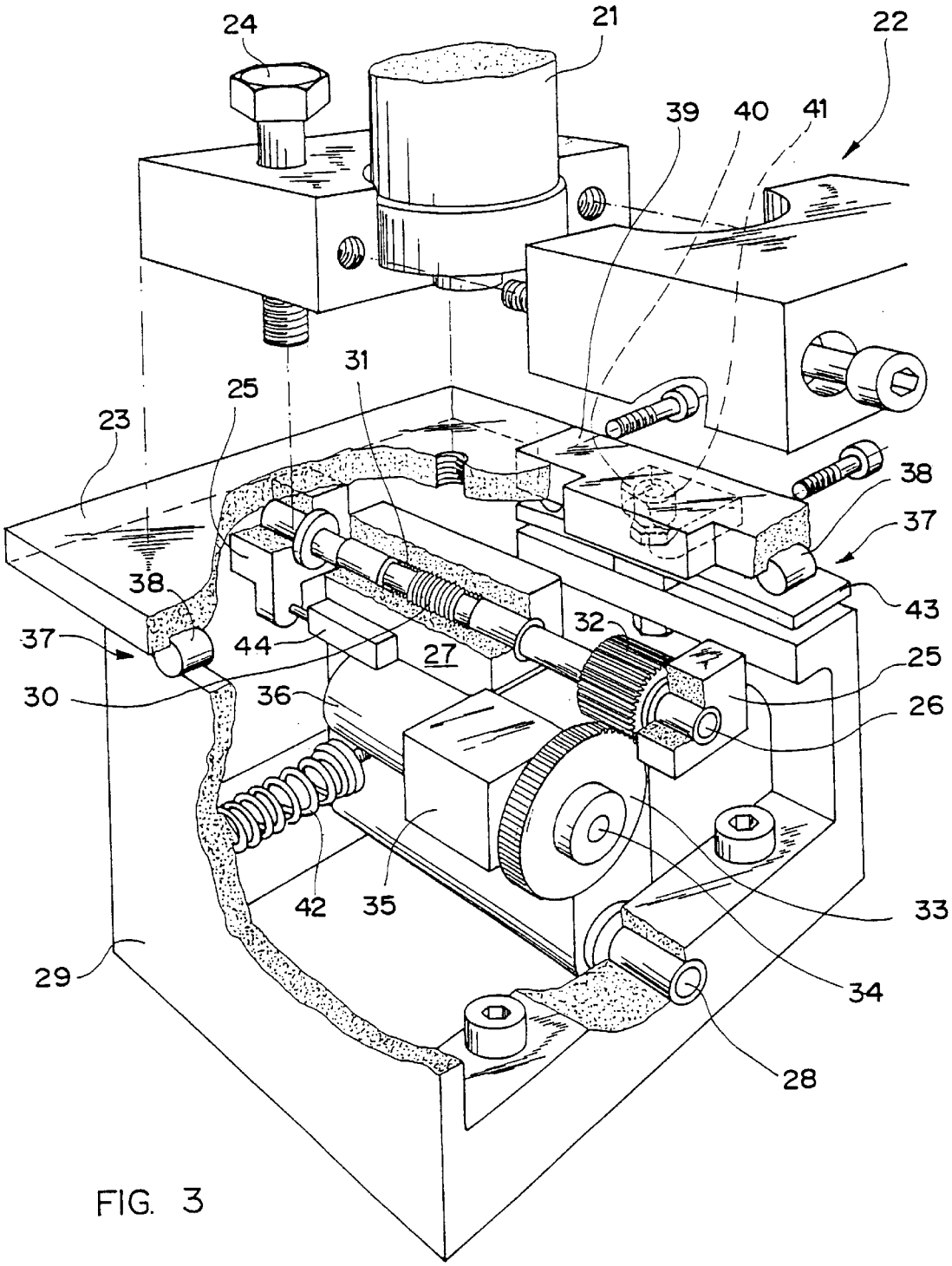
FIG. 3 is a perspective view, partially cut away, of an embodiment of the inventive apparatus based on the principle of FIG. 2.

As may be seen from FIG. 3, a journal 21 of an inking roller (not shown) is mounted in a bearing arrangement 22 consisting of two halves, whereby an inking roller can easily be replaced in a manner known per se. Bearing arrangement 22 is secured by screws 24 to a support part 23 in the form of a table. The side of support part 23 facing away from bearing arrangement 22 is provided with two flaps 25 in which a first spindle 26 is rotatingly but non-slidingly mounted. One end of a swiveling lever 27 is pivoted about first spindle 26.

The other end of swiveling lever 27 is mounted pivotingly and non-slidingly about a second spindle 28, aligned parallel to spindle 26, in a mount 29 secured to the machine frame (not shown) of the printing machine.

In the midsection of spindle 26 is a thread 30 screwed into a matching counterthread 31 in swiveling lever 27. Also fixed to spindle 26 for rotation therewith is a pinion 32 meshing with a gearwheel 33 secured to the driven shaft 34 of a gear mechanism 35 flanged onto an electric motor 36. Motor 36, and consequently gear mechanism 35 with gearwheel 33, are se- cured to swiveling lever 27. Through rotation of first spindle 26, thread 30 screwed into counterthread 31 causes spindle 26 to be displaced longitudinally, and as a result, support part 23 is moved along with it.

In order to keep support part 23 from tipping about spindle 26, it is provided with underpinning means 37 in the form of rollers 38 affixed to both edges of support part 23 and designed to roll substantially on matching runways of support part 23 and mount 29.

Secured to support part 23 is a component 39 to which a control surface 40 is affixed, corresponding to control surface 10 of FIGS. 1 and 2. Control surface 40 co-operates with a guide part 41 which is secured to mount 29 and corresponds to guide part 8 of FIGS. 1 and 2. Control surface 40, too, has an adjustment zone and a further zone for disengaging the inking roller, as has been described in connection with FIGS. 1 and 2.

A resilient element 42 in the form of a compression spring disposed between mount 29 and swiveling lever 27 causes support part 23, and thus control surface 40, to be pressed against guide part 41.

During displacement of support part 23 relative to swiveling lever 27, control surface 40 follows guide part 41. The adjustment zone of control surface 40 is then aligned substantially parallel to angle bisector 13, as has been described in connection with FIG. 2. During the displacement of support part 23, brought about by rotation of first spindle 26, swiveling lever 27 effects a swiveling movement elicited by control surface 40, especially when it is a question of disengaging the distributor roller. In order to avoid deformation of support part 23 on mount 29, upon which support part 23 is buttressed by underpinning means 37, a plate spring 43 is inserted between underpinning means 37, which are affixed to an edge of support part 23, and mount 29. Slight deflections of support part 23 toward mount 29 can be absorbed thereby.

In order to be able to ascertain the position of support part 23 in relation to swiveling lever 27 and consequently mount 29, a position indicator 44, electrically connected to a control unit, is affixed to swiveling lever 27, as will be described below.

Figure 4:
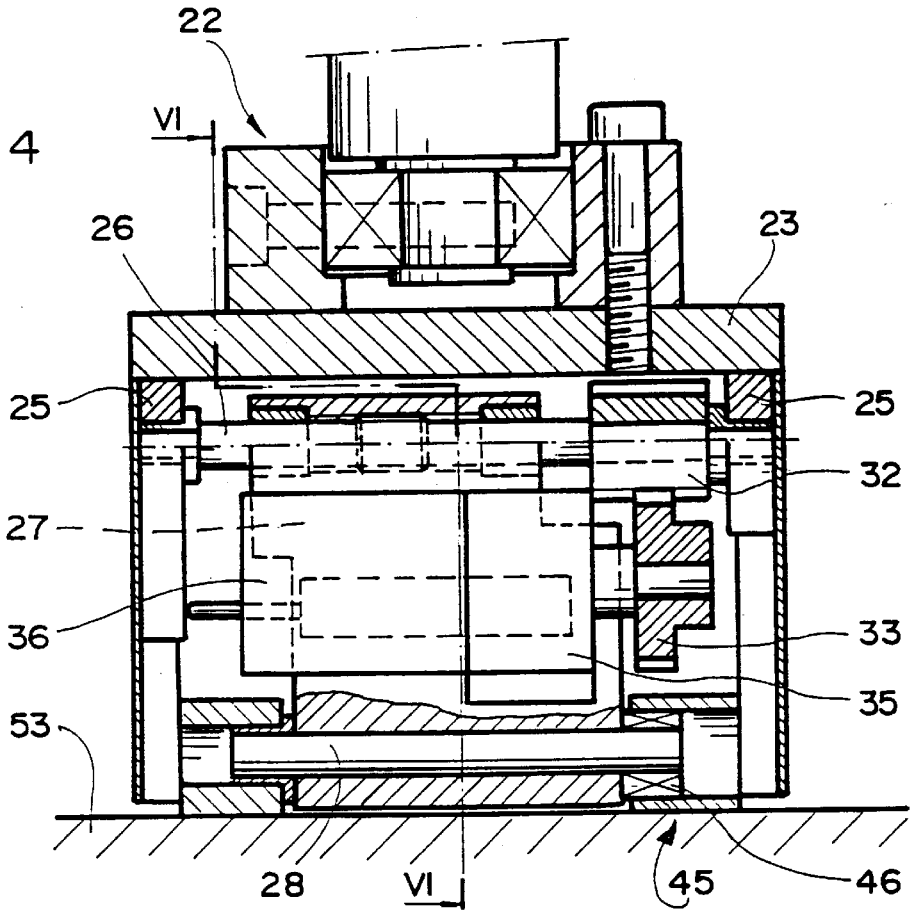
FIG. 4 is a sectional view through the inventive apparatus of FIG. 3, taken on a plane determined substantially by the first and second spindles.

FIG. 4 shows bearing arrangement 22 secured to support part 23. As already mentioned, first spindle 26 is mounted rotatingly but non-slidingly in the two flaps 25 of support part 23. Upon rotation of spindle 26, it is displaced relative to swiveling lever 27 and carries support part 23 along. Pinion 32 is consequently likewise displaced relative to gearwheel 33, which is why it is suitably wide.

Second spindle 28, which is held in mount 29 and about which swiveling lever 27 pivots, may be equipped with a dynamometer arrangement 45, consisting, for example, of a pressure gauge 46 inserted in swiveling lever 27 and receiving the bearing of second spindle 28. Pressure gauge 26 is electrically connected to a control unit, as will be described below.

Mount 29 is secured to a machine frame 53 of the printing machine.

Figure 5:
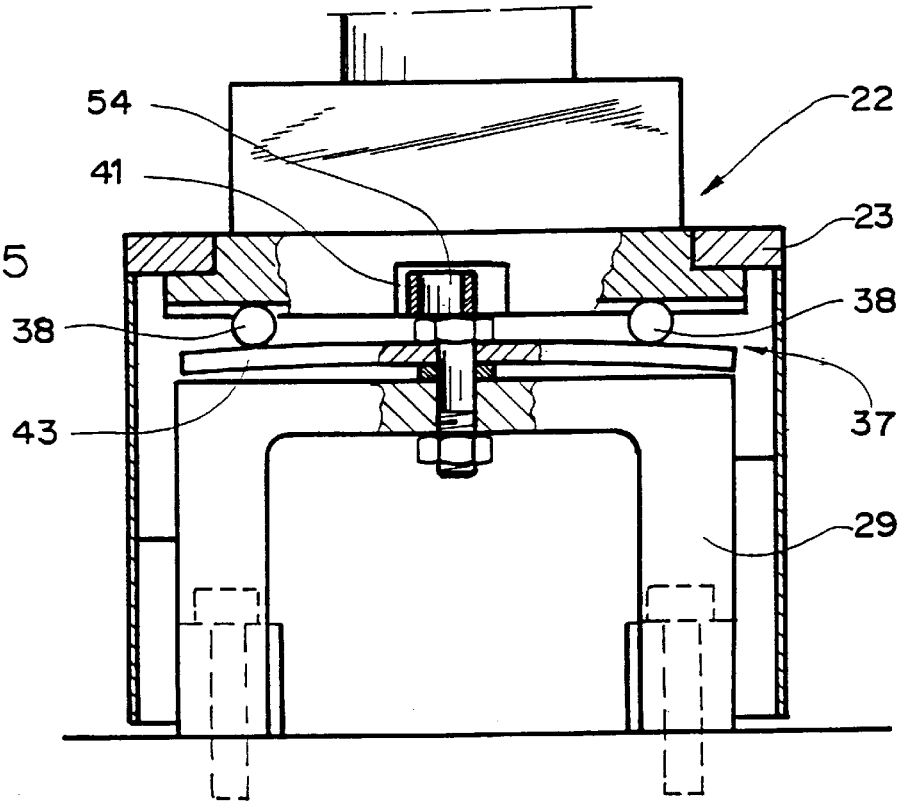
FIG. 5 is a sectional view of the inventive apparatus of FIG. 3, taken on a plane situated in the region of the resilient underpinning of the support part and the control surface.

FIG. 5 shows rollers 38 disposed at the edge of support part 23 and forming underpinning means 37. Rollers 38 essentially rest directly against support part 23 on one side but act on the opposite side upon plate spring 43, which is set on mount 29 and permits a slight movement of support part 23 toward mount 29.

Figure 6:
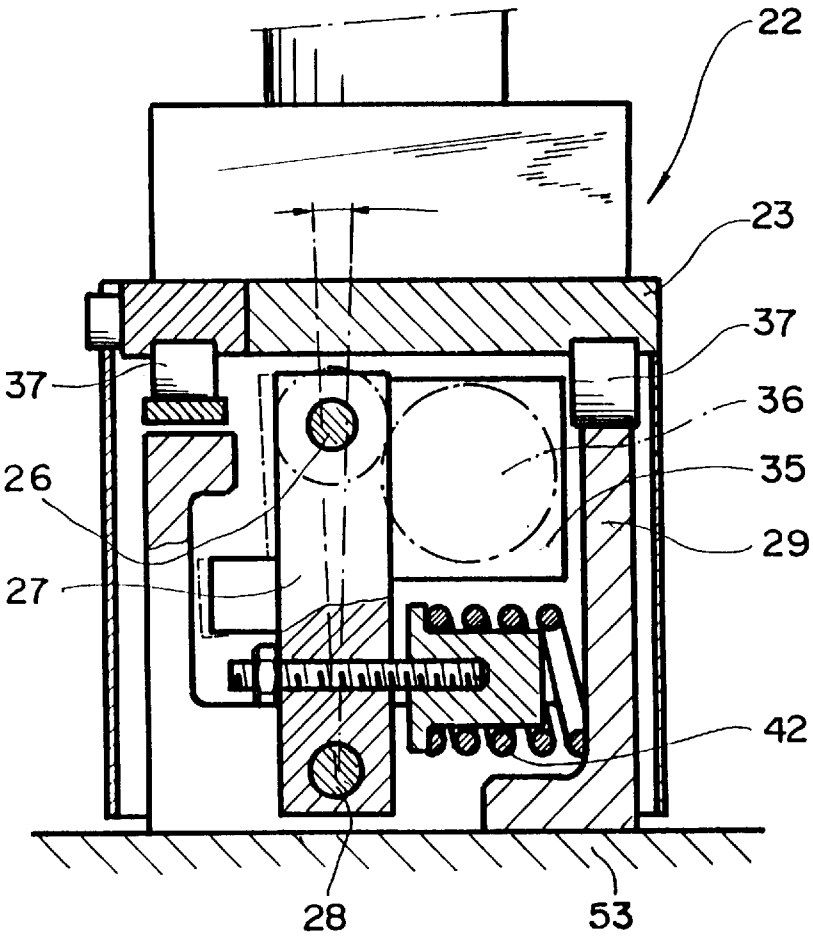
FIG. 6 is a sectional view of the inventive apparatus taken on the line VI—VI of FIG. 4.

Bearing arrangement 22 secured to support part 23 is again seen in FIG. 6, together with underpinning means 37 by which support part 23 is buttressed on mount 29. Particularly illustrated in this drawing figure is the pivoting of swiveling lever 27 about second spindle 28. Swiveling lever 27, and with it support part 23 comprising control surface 40 (FIG. 3), is pressed against guide part 41 (FIG. 3) by compression spring 42.

Figure 7:
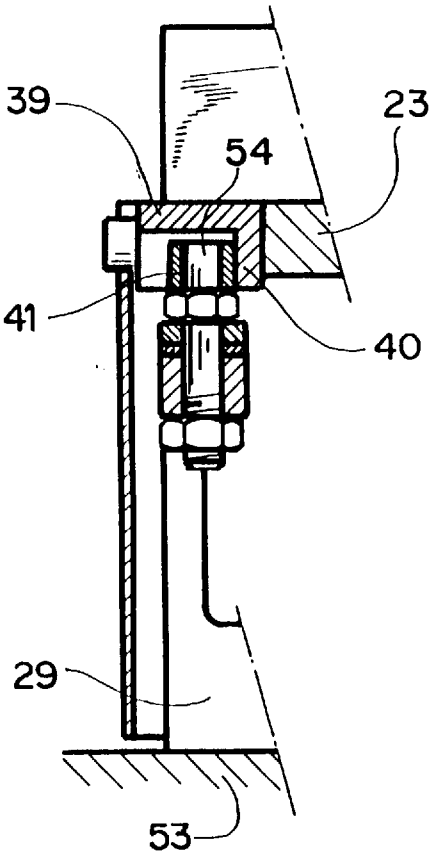
FIG. 7 is a detail, partially in section, of the cam and of the guide part co-operating therewith.

FIG. 7 shows guide part 41 secured to mount 29, as well as control surface 40 provided in component 39, which is secured to support part 23. Guide part 41 is fitted on an adjustable eccentric 54, as may also be seen in FIG. 5. Eccentric 54 may, for example, be set during assembly of the inventive apparatus, whereby a higher contact pressure of inking roller 3 against plate cylinder 1 than against distributor roller 2 may be selected, for instance.

As already mentioned, component 39 containing control surface 40 is exchangeable, whereby the ratio, e.g., of the contact pressure of the inking roller/distributor roller to the contact pressure of the inking roller/plate cylinder, can be influenced.

Figure 8:
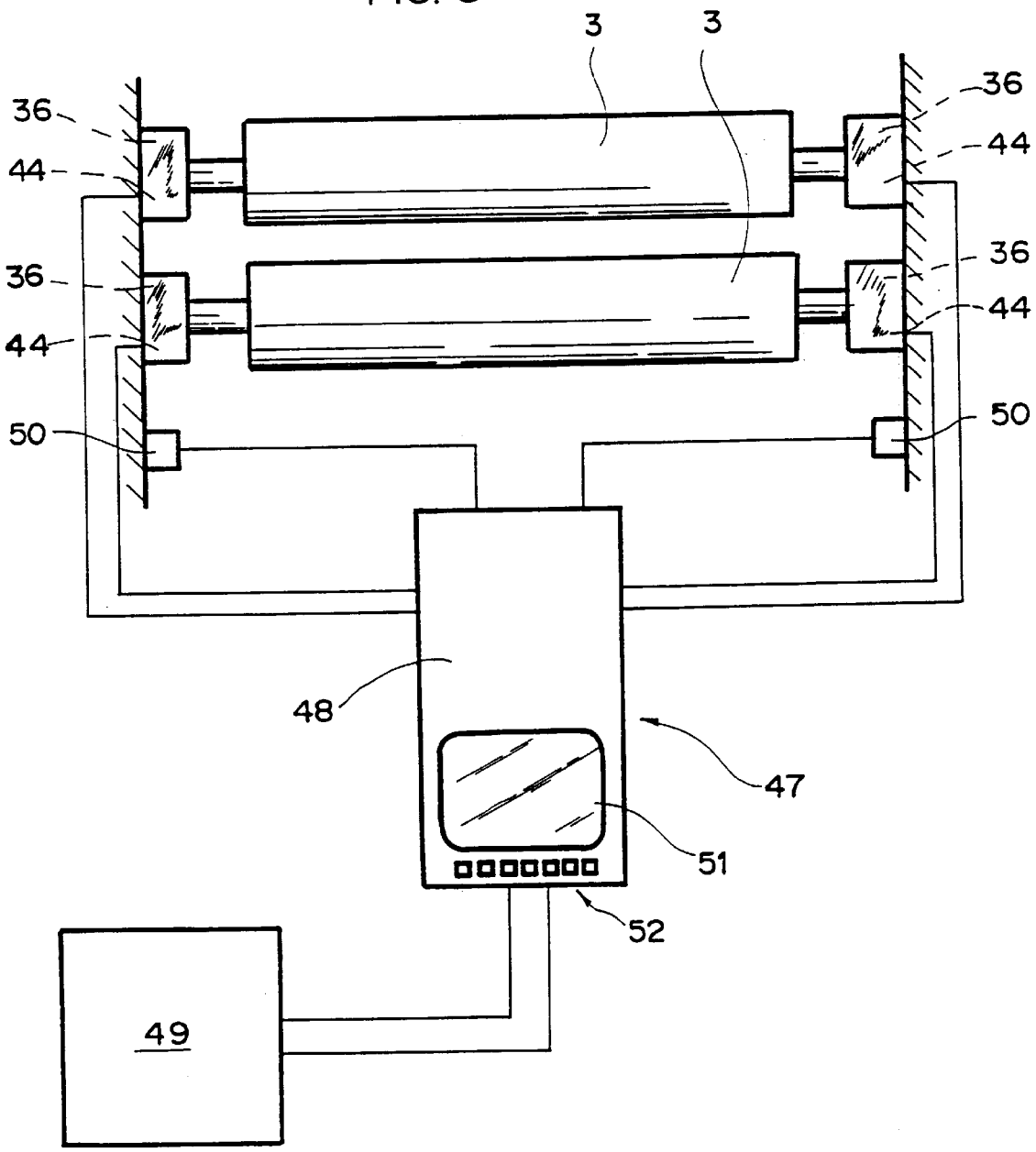
FIG. 8 is a block diagram of a modification of an electrical control for the inventive apparatus.

For adjusting and disengaging inking roller 3 with respect to the distributor roller and plate cylinder, for example, a control unit 47 is provided, as diagrammatically illustrated in FIG. 8. Unit 47 may, for example, contain a stored-program control 48 by which the default position of inking roller 3 is preset. The actual position of inking roller 3 is reported back to stored-program control 48 by position indicator 44. By activating motor 36, the inking roller is adjusted accordingly. For determining the set point of the respective roller position, data from a machine control 49 may also be supplied to stored-program control 48, e.g., concerning speed, running time, engagement and disengagement, etc.

It is also possible to enter other actual values in stored-program control 48, e.g., the contact pressure determined via dynamometer arrangement 45, or other values determined directly on the machine by means of measuring probes 50. Here the roller diameter of the adjustable roller may also be entered, based upon which the position of the roller is adjusted accordingly.

The stored set points and actual values concerning the positions of the adjustable rollers, as well as other usable influence factors which may affect the position of the adjustable roller, may be displayed and checked on a monitor 51 of stored-program control 48, but they may also be modified by means of a keyboard 52 likewise forming part of control unit 47.

By means of the inventive apparatus, adjustment of the respective roller in relation to two adjacent rollers is made optimally possible. The construction of this apparatus may be kept simple, and the adjustment may be automatically controlled as a function of the parameters of the machine to be taken into account.

We claim:

1. Apparatus for adjusting a roller of a printing machine relative to two adjacent rollers rotatingly mounted in a machine frame of the printing machine, comprising:

a first spindle bearing said roller, two bearing arrangements, ends of said first spindle being rotatingly mounted in respective said bearing arrangements, a control surface including at least one adjustment zone, a guide part disposed in each of said bearing arrangements and cooperating with said control surface, and a single linear drive capable of displacing said bearing arrangements relative to said machine frame in a plane perpendicular to said first spindle, said adjustment zone running substantially parallel to an angle bisector of an angle formed by two connection lines contained in said plane, each of said lines connecting the axis of said roller to one of the said two adjacent rollers.

2. The apparatus of claim 1, further comprising a resilient element pressing said guide part against said control surface.

3. The apparatus of claim 2, wherein said two adjacent rollers are a distributor roller and a plate cylinder and said roller is an inking roller disposed between said distributor roller and said plate cylinder, said control surface including a further zone adjoining said adjustment zone and inclined toward said distributor roller, said control surface being so disposed that a pressing force exerted by said resilient element is directed toward said distributor roller, said inking roller being supported in said further zone by the pressing force exerted on said distributor roller by said resilient element, and a space being created between said control surface and said guide part, whereby said inking roller is disengaged from said plate cylinder.

4. The apparatus of claim 1, further comprising a mount integral with said machine frame and a support part secured to each of said bearing arrangements and held in said mount, each said support part being displaceable along said control surface relative to said mount, said control surface being disposed on said support part, and said guide part being fixed to said mount.

5. The apparatus of claim 4, further comprising a second spindle disposed substantially parallel to said first spindle and at least one swiveling lever held in said mount and pivoted at one end about said second spindle, said first spindle being disposed substantially parallel to said adjustment zone of said control surface, and said support part being pivoted at the other end of said at least one swiveling lever about said first spindle.

6. The apparatus of claim 5, wherein said support part is axially displaceable along one of said first spindle and said second spindle.

7. The apparatus of claim 5, further comprising underpinning means disposed beneath two edge areas of said support part for buttressing said support part on said mount, said swiveling lever being pivoted on said support means substantially in the middle thereof.

8. The apparatus of claim 7, wherein said underpinning means are rollers, said apparatus further comprising resilient means supporting said rollers on said mount at one of said two edge areas.

9. The apparatus of claim 6, further comprising a motor and a gear mechanism, said first spindle including a thread disposed substantially in the middle thereof, said swiveling lever including a counterthread matching and engaging said thread, and said first spindle being held non-slidingly in said support part and being drivable in both directions of rotation by means of said motor and said gear mechanism.

10. The apparatus of claim 9, wherein said gear mechanism includes a driven shaft, said apparatus further comprising a pinion fixed to said first spindle for rotation therewith and a gearwheel secured to said driven shaft and meshing with said pinion, said motor and said gear mechanism being secured to said swiveling lever.

11. The apparatus of claim 4, further comprising a component secured detachably and replaceably to said support part, said control surface being disposed on said component, and said guide part being adjustable with respect to said mount.

12. The apparatus of claim 5, further comprising a spring for pressing said swiveling lever and said control surface connected thereto against said guide part.

13. The apparatus of claim 1, further comprising a control unit for causing said roller to be adjusted automatically as a function of selectable parameters.

14. The apparatus of claim 1, further comprising a position indicator is for determining the momentary position of said roller.

15. The apparatus of claim 1, further comprising a dynamometer arrangement for measuring the contact pressure of said roller against said adjacent rollers.

* * * * *

UNITED STATES PATENT AND TRADEMARK OFFICE

CERTIFICATE OF CORRECTION

PATENT NO. : 5,819,656

DATED : October 13, 1998

INVENTOR(S) : Peter GERTSCH et al.

It is certified that error appears in the above-identified patent and that said Letters Patent is hereby corrected as shown below:

On the Title page, Item [30], Foreign Application Priority Data information is incorrect. It should be:

--Sep. 3, 1996 [EP] European Pat. Off. .....96810580--

Signed and Sealed this

Fourth Day of May, 1999

*Attest:*

*Attesting Officer*

Q. TODD DICKINSON

*Acting Commissioner of Patents and Trademarks*